US011814836B2

(12) United States Patent
Sourcis et al.

(10) Patent No.: US 11,814,836 B2
(45) Date of Patent: Nov. 14, 2023

(54) ACOUSTIC INSULATION PRODUCT COMPRISING A BACKING LAYER

(71) Applicants: SAINT-GOBAIN ISOVER, Courbevoie (FR); SAINT-GOBAIN PLACO, Courbevoie (FR)

(72) Inventors: Benjamin Sourcis, Paris (FR); Pierre Leroy, Saint Felix (FR)

(73) Assignees: SAINT-GOBAIN ISOVER, Courbevoie (FR); SAINT-GOBAIN PLACO, Courbevoie (FR)

( * ) Notice: Subject to any disclaimer, the term of this patent is extended or adjusted under 35 U.S.C. 154(b) by 86 days.

(21) Appl. No.: 17/604,267

(22) PCT Filed: Apr. 6, 2020

(86) PCT No.: PCT/EP2020/059729
§ 371 (c)(1),
(2) Date: Oct. 15, 2021

(87) PCT Pub. No.: WO2020/212177
PCT Pub. Date: Oct. 22, 2020

(65) Prior Publication Data

US 2022/0195723 A1 Jun. 23, 2022

(30) Foreign Application Priority Data

Apr. 16, 2019 (EP) ..... 19169606

(51) Int. Cl.
*E04B 1/86* (2006.01)
*E04B 9/00* (2006.01)
(Continued)

(52) U.S. Cl.
CPC ..... *E04B 1/86* (2013.01); *E04B 9/001* (2013.01); *E04B 9/045* (2013.01); *E04B 9/241* (2013.01);
(Continued)

(58) Field of Classification Search
CPC . E04B 1/86; E04B 9/001; E04B 9/045; E04B 9/241; E04B 2001/8281; E04B 2001/8461; E04B 2001/848
See application file for complete search history.

(56) References Cited

U.S. PATENT DOCUMENTS 6,877,585 B2 * 4/2005 Tinianov ..... E04B 1/86 181/290
7,033,963 B2 * 4/2006 Felegi, Jr. ..... C09D 7/69 428/48
(Continued)

FOREIGN PATENT DOCUMENTS

AU 2017263076 A1 * 12/2018 ..... E04B 1/8209
EP 3 470 565 A1 4/2019
(Continued)

OTHER PUBLICATIONS

International Search Report as issued in International Patent Application No. PCT/EP2020/059729, dated Jul. 14, 2020.
(Continued)

*Primary Examiner* — Jeremy A Luks
(74) *Attorney, Agent, or Firm* — Pillsbury Winthrop Shaw Pittman LLP

(57) ABSTRACT

An acoustic insulation product includes a panel made of porous material, based on foam or fibres, including a first face, referred to as back face, intended to face towards a wall, and a second face, referred to as front face, situated on the opposite side to the back face, and a layer, referred to as backing layer, which adheres to or is linked or coupled at least in part to the back face of the panel made of porous material, the backing layer having an airflow resistance of between 5 kPa·s/m and 20 kPa·s/m.

20 Claims, 1 Drawing Sheet

(51) Int. Cl.

| | |
|---|---|
| ***E04B 9/04*** | (2006.01) |
| ***E04B 9/24*** | (2006.01) |
| ***E04B 1/82*** | (2006.01) |
| ***E04B 1/84*** | (2006.01) |

(52) U.S. Cl.
CPC . *E04B 2001/8281* (2013.01); *E04B 2001/848* (2013.01); *E04B 2001/8461* (2013.01)

(56) References Cited

U.S. PATENT DOCUMENTS 7,320,739 B2 * 1/2008 Thompson, Jr. ..... B32B 5/04 156/196
8,371,084 B2 * 2/2013 Babineau, Jr. ..... E04B 9/045 181/290
2004/0231914 A1 * 11/2004 Thompson, Jr. ..... B32B 27/12 181/284
2005/0211500 A1 * 9/2005 Wendt ..... E04B 9/0464 181/290
2006/0254855 A1 * 11/2006 Loftus ..... E04B 1/84 181/293
2010/0126800 A1 * 5/2010 Albin, Jr. ..... B60R 13/0815 427/428.01
2010/0147621 A1 * 6/2010 Gillette ..... D04H 1/43828 156/308.2
2011/0186381 A1 * 8/2011 Ogawa ..... G10K 11/162 181/294
2011/0284319 A1 * 11/2011 Frederick ..... E04B 1/86 181/294
2014/0124291 A1 * 5/2014 Dugan ..... E04C 2/043 181/290
2016/0138264 A1 * 5/2016 Kragness ..... B32B 37/24 428/196
2016/0159028 A1 * 6/2016 Oleske ..... B32B 15/04 428/116
2020/0189242 A1 * 6/2020 Cai ..... B32B 13/042

FOREIGN PATENT DOCUMENTS

FR 2 924 850 A1 6/2009
FR 3046214 A1 * 6/2017 ..... C03C 13/06
WO WO 2019/014096 A1 1/2019

OTHER PUBLICATIONS

Langlois, C., et al., "Polynomial relations for quasi-static mechanical characterization of isotropic poroelastic materials," J. Acoust. Soc. Am., 110 (6), Dec. 2001, pp. 3032-3040.

* cited by examiner

ACOUSTIC INSULATION PRODUCT COMPRISING A BACKING LAYER

CROSS-REFERENCE TO RELATED APPLICATIONS

This application is the U.S. National Stage of PCT/EP2020/059729, filed Apr. 6, 2020, which in turn claims priority to European patent application number 19169606.1 filed Apr. 16, 2019. The content of these applications are incorporated herein by reference in their entireties.

The invention relates to an acoustic insulation product intended to be used in particular as a suspended ceiling tile.

Suspended ceilings are very widely used in the tertiary sector in order to conceal technical equipment above halls. The space located above a suspended ceiling is referred to as the plenum. From an acoustic perspective, suspended ceilings perform two main roles:

- good absorption of acoustic waves (which is essential for acoustic comfort),
- and, optionally, acoustic insulation between two neighboring rooms connected by a plenum located above the suspended ceiling.

Suspended ceiling tiles are often composed of a panel based on fibers such as mineral wool, or made of another porous material, to which are attached:

- a front web providing an aesthetic function and acoustic correction for absorption, and
- a back web providing airtightness between the hall and the plenum.

These acoustic systems have substantially two drawbacks:

- poor acoustic absorption at low frequencies, and
- resonance phenomena in the plenum, which propagate the sound via the ceiling, which has a negative impact on acoustic insulation.

There is therefore a need for an acoustic insulation product which makes it possible to improve both the acoustic insulation and the acoustic absorption.

To this end, the invention proposes an acoustic insulation product, comprising:

- a panel made of porous material, in particular based on foam or fibers, comprising a first face, referred to as back face, intended to face towards a wall surface, such as a ceiling or a wall, and a second face, referred to as front face, situated opposite to the back face,
- a layer, referred to as backing layer, which adheres to or is linked or coupled at least in part to the back face of the panel made of porous material, the backing layer having an airflow resistance of between 5 kPa·s/m and 20 kPa·s/m, preferably between 7 kPa·s/m and 15 kPa·s/m.

According to another particular feature, the backing layer is a woven or nonwoven fibrous web, a layer of paint or else a layer of compressed mineral wool, or even a plastic film or any other material in the form of a membrane or film.

According to another particular feature, the backing layer has a thickness of less than or equal to 1 cm, preferably less than or equal to 1 mm.

According to another particular feature, the backing layer is microperforated.

According to another particular feature, the microperforated backing layer has, for a thickness L, a degree of perforation $\phi$ and a perforation diameter D such that $\phi D^2=32\eta\times L/(\sigma L)$, where $\sigma L$ denotes the airflow resistance of the microperforated backing layer and $\eta$ the dynamic viscosity of the air.

According to another particular feature, the panel made of porous material, based on foam or fibers, is a panel made of mineral and/or plant and/or synthetic wool, a panel made of foam with open porosity, or else a panel of agglomerated fibers obtained by the wet route.

According to another particular feature, the panel made of porous material has a surface density of between 0.8 kg/m$^2$ and 10 kg/m$^2$.

According to another particular feature, the panel made of porous material has an airflow resistivity of between 30 kPa·s/m$^2$ and 120 kPa·s/m$^2$, preferably between 50 kPa·s/m$^2$ and 110 kPa·s/m$^2$, or even between 50 kPa·s/m$^2$ and 100 kPa·s/m$^2$, or else between 50 kPa·s/m$^2$ and 90 kPa·s/m$^2$, or even between 50 kPa·s/m$^2$ and 80 kPa·s/m$^2$.

According to another particular feature, the panel made of porous material has a Young's modulus of between 0.1 MPa and 4 MPa, preferably of between 0.5 MPa and 4 MPa, even more preferably of between 0.8 MPa and 4 MPa, or even between 1.2 MPa and 4 MPa, or else between 1.5 MPa and 4 MPa, or between 2 MPa and 4 MPa.

According to another particular feature, the panel made of porous material has a thickness of between 10 mm and 60 mm.

According to another particular feature, the acoustic insulation product further comprises a second layer, referred to as front layer, in the form of a web, a membrane, a film, a paint or a plaster layer, connected or adhesively bonded to the front face of the panel made of porous material, this front layer having an airflow resistance of less than or equal to 1 kPa·s/m, preferably less than or equal to 0.5 kPa·s/m.

According to another particular feature, the acoustic insulation product is intended to be used as an acoustic ceiling tile on a frame suspended from a ceiling with a plenum between the acoustic insulation product and the ceiling.

The acoustic insulation product may also perform a function of thermal insulation, in particular in the case of ceiling systems or temperature-regulating (heating and/or cooling) walls. This embodiment is also covered by the invention.

The invention also relates to an acoustic insulation system suspended under a ceiling or in front of a wall, comprising a structure for suspending an insulating cladding at a distance from the ceiling or from the wall, wherein the cladding comprises at least one acoustic insulation product according to the invention, the backing layer being oriented toward the ceiling or the wall.

The invention also relates to a use of the acoustic insulation product according to the invention as an acoustic ceiling tile on a frame suspended from a ceiling with a plenum between the acoustic insulation product and the ceiling, the backing layer being oriented toward the ceiling or the wall.

Other features and advantages of the invention will now be described in relation to the drawings, in which.

Identical reference numerals in the different figures represent identical or similar elements.

Figure 1:
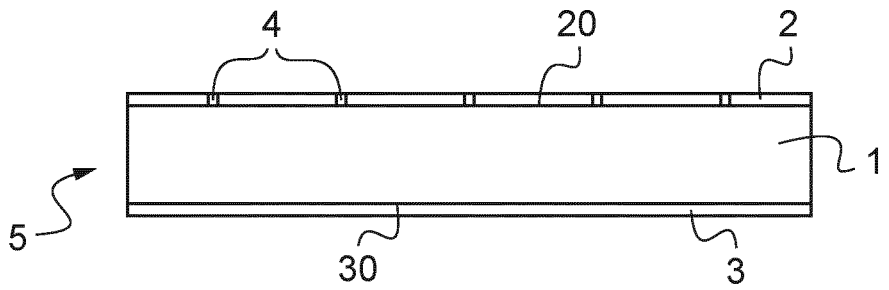
FIG. 1 shows a sectional view of an acoustic insulation product according to the invention.

The invention relates to an acoustic insulation product, comprising:

- a panel made of porous material, in particular based on foam or fibers comprising a first face, referred to as back face, intended to face towards a wall surface, such as a ceiling or a wall, and a second face, referred to as front face, situated opposite to the back face, a layer, referred to as backing layer, which adheres to or is linked or coupled at least in part to the back face of the panel made of porous material, the backing layer having an airflow resistance of between 5 kPa·s/m and 20 kPa·s/m, preferably between 7 kPa·s/m and 15 kPa·s/m.

The airflow resistance is measured according to standard ISO 9053.

The airflow resistance of the backing layer according to the invention represents a limited ability of air to pass through said backing layer, which may be linked to the presence of small pores in the layer. Since the airflow resistance of the backing layer is between 5 kPa·s/m and 20 kPa·s/m, it introduces energy dissipation by viscous friction of the air caused to move by the acoustic wave. When the acoustic waves which have not dissipated in the panel made of porous material and in the backing layer pass into the plenum, they undergo multiple reflections. During these multiple reflections, a portion of the acoustic waves is reflected onto the backing layer and is absorbed by same, by virtue of the flow resistance of the backing layer, unlike the case in which the backing layer is leaktight. Thus, absorption is greatly improved, in particular at low frequencies.

The invention also overcomes a disadvantage of the leaktight back webs of the prior art which, by forming a virtually perfectly reflective face for acoustic waves, amplify the energy of the resonance modes in the plenum.

Contrary to this, the airflow resistance of the backing layer according to the invention allows a portion of the acoustic waves to pass therethrough. The acoustic insulation between the hall and the plenum is therefore slightly degraded. Nonetheless, the airflow resistance of the backing layer is chosen so as not to degrade the acoustic insulation, i.e. to retain the inertial effects of the panel made of porous material. Further, since a portion of the acoustic waves is dissipated in the backing layer, the intensity of the acoustic waves reflected into the plenum is reduced and the acoustic insulation between two neighboring halls is improved. The dissipation provided in the plenum by the backing layer reduces the propagation of waves in this same plenum. This phenomenon compensates for the loss of inertial effect due to passage into the backing layer and, when the flow resistance of the backing layer is advantageously selected in the range according to the invention, makes it possible to improve the acoustic insulation $D_{nf}$ from one room to another.

Thus, the acoustic insulation product according to the invention does indeed make it possible to improve both the acoustic insulation and the acoustic absorption.

FIG. 1 shows a sectional view of an acoustic insulation product according to the invention. The acoustic insulation product 5 comprises a panel made of porous material 1, in particular based on foam or fibers. Thus, the panel made of porous material 1 is for example a panel made of mineral and/or plant and/or synthetic wool, a panel made of foam with open porosity, or else a panel of agglomerated fibers obtained by the wet route, such as mineral and/or cellulose fibers shaped by suspension with a mineral or organic binder.

The panel made of porous material has a first main face, referred to as back face 20, intended to face toward a wall surface which may be a ceiling (7 in FIG. 2) or a wall, and a second face, referred to as front face, situated opposite to the back face 20. The front face is intended to face toward the interior of a hall, a room (4 on FIG. 2) or else a corridor.

The acoustic insulation product 5 further comprises a layer, referred to as backing layer 2, which adheres to or is linked or coupled at least in part to the back face 20 of the panel made of porous material 1. The linking or adhesion is preferably produced by adhesive bonding, for example in the form of glue dots or lines. It is not necessarily the whole surface of the backing layer which is coated with adhesive. The backing layer 2 is for example a woven or nonwoven fibrous web, a layer of paint or else a layer of compressed mineral wool, or even a plastic film or any other type of material in the form of a film or membrane. When the backing layer 2 is a layer of paint, the latter is placed on the panel made of porous material 1 in liquid form, and dried. There is then no adhesive bonding step, but a step of coating with a primer may take place. The paint may optionally contain a pore-forming agent to give adequate air passage resistance.

The backing layer 2 has an airflow resistance of between 5 kPa·s/m and 20 kPa·s/m in order to enable the improvement both in the acoustic absorption, in particular at low frequencies, and in the acoustic insulation, as explained above. It is this carefully chosen range of airflow resistance which enables this technical effect. Indeed, below 5 kPa·s/m, acoustic insulation is degraded. Above 20 kPa·s/m, there is no longer a gain in absorption. Preferably, the airflow resistance is between 7 kPa·s/m and 15 kPa·s/m, which makes it possible to further improve the acoustic absorption and the acoustic insulation. The airflow resistance is measured according to standard ISO 9053.

The backing layer has for example a thickness of less than or equal to 1 cm, preferably less than or equal to 1 mm.

In a particular embodiment shown in FIG. 1, the backing layer 2 can be microperforated, i.e. microperforations 4 are made through the backing layer 2. These microperforations 4 may for example be made in a backing layer 2 already in place on the panel made of porous material 1, which has the advantage of not blocking the microperforations 4 during the adhesive bonding of the backing layer 2 to the panel made of porous material 1. In this embodiment, the microperforations 4 can be produced in a backing layer 2 consisting of a web of fibers which is referred to as leaktight (having an airflow resistance before perforation of greater than 50 kPa·s/m) so as to give it an airflow resistance after perforation of between 5 kPa·s/m and 20 kPa·s/m, preferably between 7 kPa·s/m and 15 kPa·s/m.

When the backing layer 2 is microperforated, it has, for example, for a thickness L, a degree of perforation $\phi$ and a perforation diameter D such that:

$$\phi D^2 = 32\eta \times L/(\sigma L)$$

where $\sigma L$ denotes the airflow resistance of the microperforated backing layer and $\eta$ the dynamic viscosity of the air.

As a variant, the backing layer may be pierced with microperforations of multiple diameters.

Furthermore, the panel made of porous material 1 preferably has a surface density of between 0.8 kg/m$^2$ and 10 kg/m$^2$, so as to have sufficient mechanical strength for an application as ceiling tile, while not being too heavy.

The panel made of porous material 1 preferably has an airflow resistivity of between 30 kPa·s/m$^2$ and 120 kPa·s/m$^2$ so as to absorb acoustic waves. Preferably, the panel made of porous material 1 has an airflow resistivity of between 50 kPa·s/m$^2$ and 110 kPa·s/m$^2$, or even between 50 kPa·s/m$^2$ and 100 kPa·s/m$^2$, or else between 50 kPa·s/m$^2$ and 90 kPa·s/m$^2$, or even between 50 kPa·s/m$^2$ and 80 kPa·s/m$^2$, in order to improve the acoustic absorption thereof. The measure of airflow resistivity is obtained by dividing the airflow resistance of the panel by its thickness.

The panel made of porous material 1 preferably has a Young's modulus of between 0.1 MPa and 4 MPa so as to provide acoustic insulation. Preferably, the panel made of porous material 1 has a Young's modulus of between 0.5 MPa and 4 MPa, even more preferably of between 0.8 MPa and 4 MPa, or even between 1.2 MPa and 4 MPa, or else between 1.5 MPa and 4 MPa, or between 2 MPa and 4 MPa, in order to improve the acoustic insulation thereof. The Young's modulus is measured according to standard ISO 18437 and according to the article by C. Langlois, R. Panneton and N. Atalla: Polynomial relations for quasi-static mechanical characterization of isotropic poroelastic materials, J. Acoust. Soc. Am., 110:3032-3040, 2001.

The panel made of porous material 1 further preferably has a thickness of between 10 mm and 60 mm. This thickness range enables a good mechanical strength of the panel and sufficient absorption of acoustic waves for an application as ceiling tile.

The acoustic insulation product 5 preferably further comprises a second layer, referred to as front layer 3, in the form of a web, a membrane, a film, a paint or a plaster layer, connected or adhesively bonded to the front face 30 of the panel made of porous material 1. This front layer has a primarily decorative function. It has an airflow resistance which is less than or equal to 1 kPa·s/m, preferably less than or equal to 0.5 kPa·s/m, so as to allow sufficient air to enter the panel made of porous material 1 in order to enable acoustic insulation and absorption by the panel made of porous material 1 and by the backing layer 2.

The acoustic insulation panel 5 also preferably provides thermal insulation.

Two acoustic insulation products were tested for acoustic absorption and acoustic insulation: a reference product and a product according to the invention.

The reference acoustic insulation product tested comprises a panel made of mineral wool with a surface density of 5 kg/m$^2$, a thickness of 50 mm, a Young's modulus of 0.65 MPa and an airflow resistivity of 85 kPa·s/m, a back web made of nonwoven glass fibers having an airflow resistance of 70 kPa·s/m and a thickness of 0.6 mm, and a front web having an airflow resistance of 0.5 kPa·s/m.

The acoustic insulation product according to the invention is the same product, wherein the back web has further been pierced with microperforations of 0.18 mm in diameter, with a degree of perforation of 0.15%. The airflow resistance of the microperforated back web was measured at 7.5 kPa·s/m.

The acoustic absorption and the acoustic insulation were measured on the two products. The acoustic absorption is measured according to standard ISO 354. The indicator aw is then calculated according to standard ISO 11654. Throughout the application, the measurements were carried out with a plenum of 200 mm construction height.

The acoustic insulation is measured according to standard ISO 10848-1. The indicator $D_{nfw}$ is then calculated according to standard ISO 717-1. Throughout the application, the measurements were carried out with a plenum of 700 mm construction height.

A gain in acoustic absorption ($\alpha s$ and $\alpha w$) of 0.05 was observed over the whole frequency range between 100 Hz and 5000 Hz, and a gain in insulation of approximately +1 dB on the $D_{nf,w}$ between the acoustic insulation product according to the invention, the back web of which has an airflow resistance of 7.5 kPa·s/m, and the reference acoustic insulation product, the back web of which has an airflow resistance of 100 kPa·s/m.

It was therefore demonstrated that the acoustic insulation product according to the invention does indeed make it possible to improve both the acoustic insulation and the acoustic absorption.

The acoustic insulation product 5 is preferably intended to be used as a suspended ceiling tile. It can also be used as an acoustic cladding on any other wall surface, for example on a wall. A plenum between the acoustic insulation product and the wall surface enables optimal use of said product.

Figure 2:
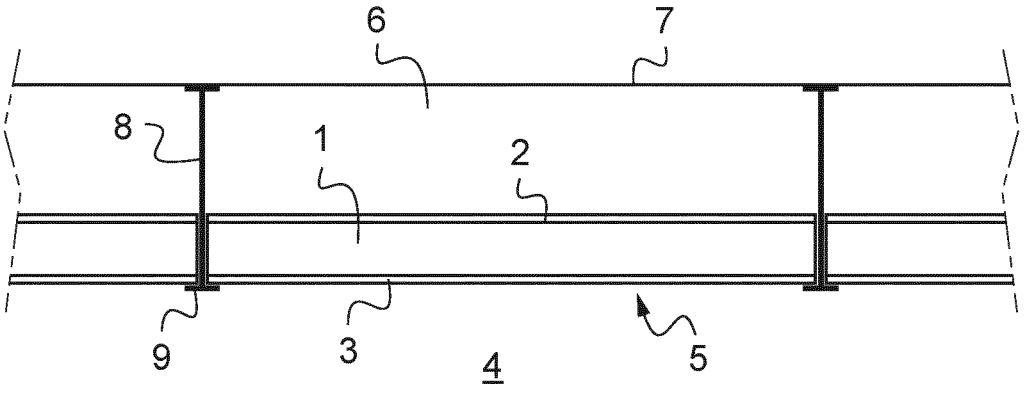
FIG. 2 shows a sectional view of an acoustic insulation product in the use thereof as suspended ceiling tile.

FIG. 2 shows a sectional view of an acoustic insulation product in the use thereof as suspended ceiling tile.

FIG. 2 shows a suspended ceiling comprising a metal frame 7 attached to a ceiling wall surface and provided, at the lower end thereof, with a flange 9 on which the ceiling tiles rest, each ceiling tile being formed of an acoustic insulation product 5 according to the invention. A plenum 6 is present between the wall surface 7 of the ceiling and the upper surface of the acoustic insulation product 5, i.e. the backing layer 2. The back face 20 of the acoustic insulation product 5, covered with the backing layer 2, is oriented toward the wall surface 7 of the ceiling. The front face 30 of the acoustic insulation product 5, covered here with a front web 3, is oriented toward the interior of a hall 4.

The invention also relates to a use of the acoustic insulation product 5 as an acoustic ceiling tile on a frame 8 suspended from a ceiling 7 with a plenum 6 between the acoustic insulation product 5 and the ceiling 7, and also to a corresponding acoustic insulation system. The invention also relates to a wall acoustic insulation system.

The invention claimed is:

1. An acoustic insulation product, comprising:

a panel made of porous material comprising a first face forming a back face, intended to face towards a wall surface and a second face forming a front face, situated opposite to the back face, a layer forming a backing layer, which adheres to or is linked or coupled at least in part to the back face of the panel made of porous material, the backing layer having an airflow resistance of between 5 kPa·s/m and 20 kPa·s/m, wherein the panel made of porous material has an airflow resistivity of between 30 kPa·s/m$^2$ and 120 kPa·s/m$^2$.

2. The acoustic insulation product according to claim 1, wherein the backing layer is a woven or nonwoven fibrous web, a layer of paint or a layer of compressed mineral wool, or a plastic film or any material in the form of a film or of a membrane.

3. The acoustic insulation product according to claim 1, wherein the backing layer has a thickness of less than or equal to 1 cm.

4. The acoustic insulation product according to claim 1, wherein the backing layer is microperforated.

5. The acoustic insulation product according to claim 4, wherein the microperforated backing layer has, for a thickness L, a degree of perforation $\phi$ and a perforation diameter D such that $\phi D^2=32\eta\times L/(\sigma L)$, where $\sigma L$ denotes the airflow resistance of the microperforated backing layer and $\eta$ the dynamic viscosity of the air.

6. The acoustic insulation product according to claim 1, wherein the panel made of porous material, based on foam or fibers, is a panel made of mineral and/or plant and/or synthetic wool, a panel made of foam with open porosity, or a panel of agglomerated fibers obtained by a wet route.

7. The acoustic insulation product according to claim 1, wherein the panel made of porous material has a surface density of between 0.8 kg/m$^2$ and 10 kg/m$^2$.

8. The acoustic insulation product according to claim 1, wherein the panel made of porous material has a Young's modulus of between 0.1 MPa and 4 MPa.

9. The acoustic insulation product according to claim 1, wherein the panel made of porous material has a thickness of between 10 mm and 60 mm.

10. The acoustic insulation product according to claim 1, further comprising a second layer forming a front layer, in the form of a web, a membrane, a film, a paint or a plaster layer, connected or adhesively bonded to the front face of the panel made of porous material, the front layer having an airflow resistance of less than or equal to 1 kPa·s/m.

11. The acoustic insulation product according to claim 1, intended to be used as an acoustic ceiling tile on a frame suspended from a ceiling with a plenum between the acoustic insulation product and the ceiling.

12. An acoustic insulation system suspended under a ceiling or in front of a wall, comprising a structure for suspending an insulating cladding at a distance from the ceiling or from the wall, wherein the cladding comprises at least one acoustic insulation product according to claim 1, the backing layer being oriented toward the ceiling or the wall.

13. The acoustic insulation product according to claim 1, wherein the panel is based on foam or fibers.

14. The acoustic insulation product according to claim 1, wherein the wall surface is a ceiling or a wall.

15. The acoustic insulation product according to claim 1, wherein the airflow resistance is between 7 kPa·s/m and 15 kPa·s/m.

16. The acoustic insulation product according to claim 3, wherein the backing layer has a thickness of less than or equal to 1 mm.

17. The acoustic insulation product according to claim 1, wherein the airflow resistivity of the panel made of porous material is between 50 kPa·s/m$^2$ and 80 kPa·s/m$^2$.

18. The acoustic insulation product according to claim 8, wherein the Young's modulus is between 2 MPa and 4 MPa.

19. The acoustic insulation product according to claim 8, wherein the first and second faces of the panel are planar faces.

20. A method comprising:

forming an acoustic ceiling tile with an acoustic insulation product on a frame suspended from a ceiling with a plenum between the acoustic insulation product and the ceiling, wherein the acoustic insulation product includes a panel made of porous material comprising a first face forming a back face, intended to face towards a wall surface and a second face forming a front face, situated opposite to the back face, and a layer forming a backing layer, which adheres to or is linked or coupled at least in part to the back face of the panel made of porous material, the backing layer having an airflow resistance of between 5 kPa·s/m and 20 kPa·s/m, and wherein the backing layer is oriented toward the ceiling, and wherein the panel made of porous material has an airflow resistivity of between 30 kPa·s/m$^2$ and 120 kPa·s/m$^2$.

* * * * *